US012078062B2

(12) United States Patent
Alghuryafi et al.

(10) Patent No.: US 12,078,062 B2
(45) Date of Patent: Sep. 3, 2024

(54) AUTOMATED INFLOW NEGATIVE TEST PROCESS

(71) Applicant: SAUDI ARABIAN OIL COMPANY, Dhahran (SA)

(72) Inventors: Ahmed M. Alghuryafi, Qatif (SA); Abdullah H. Oqaili, Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 63 days.

(21) Appl. No.: 17/937,373

(22) Filed: Sep. 30, 2022

(65) Prior Publication Data

US 2024/0110475 A1 Apr. 4, 2024

(51) Int. Cl.
*E21B 49/00* (2006.01)
*E21B 47/007* (2012.01)

(52) U.S. Cl.
CPC ..... *E21B 49/008* (2013.01); *E21B 47/007* (2020.05)

(58) Field of Classification Search
CPC ..... E21B 49/008; E21B 47/007
USPC ..... 702/12
See application file for complete search history.

(56) References Cited

U.S. PATENT DOCUMENTS 4,829,831 A 5/1989 Kefer et al.
6,176,323 B1 * 1/2001 Weirich ..... E21B 44/005 175/40
8,991,492 B2 * 3/2015 Lovell ..... E21B 43/122 166/250.17
10,113,408 B2 * 10/2018 Pobedinski ..... E21B 21/08
2001/0039840 A1 * 11/2001 Alexander ..... G01F 1/34 73/861.49
2009/0320552 A1 12/2009 Samani

OTHER PUBLICATIONS

Terry et al. , CN 1628207A, "Drilling System", Date Published: Jun. 15, 2005 (Year: 2005).*

* cited by examiner

*Primary Examiner* — John H Le

(74) *Attorney, Agent, or Firm* — Osha Bergman Watanabe & Burton LLP

(57) ABSTRACT

A method to perform an inflow negative test of a wellbore is disclosed. The method includes disposing a flow measuring sub in a drill string to mechanically connect a drill pipe joint and a drill pipe, and sustaining a fluid flow downstream along an annulus and upstream along the drill pipe. The fluid flow reverses direction through an open port in a wall of the drill pipe or an open end of the drill pipe, and returns to a mud tank from the drill pipe through the flow measuring sub and the drill pipe joint. Flow measurement data of fluid movement through the flow measuring sub is generated using a measuring device of the flow measuring sub and sent to a computer device of the flow measuring sub. Accordingly, a success/failure result of the inflow negative test is determined using the computer device based at least on the flow measurement data.

20 Claims, 6 Drawing Sheets

AUTOMATED INFLOW NEGATIVE TEST PROCESS

BACKGROUND

During the wellbore construction process, the wellbore goes through several phases before reaching the final completion stage. In each phase, there is a casing or liner that isolates the drilled formation from the new area to be drilled. This isolation is necessary to ensure that the wellbore does not encounter any flow leakage during mud displacement. Displacement is the act of removing one fluid (usually liquid) from a wellbore and replacing it with another fluid. The mud displacement is a process to displace drilling fluid (i.e., mud) from a well system by circulating treated water or mud through well pipe and annulus to complete removal of existing drilling fluid.

Flow leakage during mud displacement can cause well control incident leading to catastrophic consequences, such as blowout. To confirm isolation integrity, the drilling operator performs an inflow positive test and an inflow negative test for installed liner top packer. The positive test is performed to confirm that there will be no fluid penetration from the wellbore to the formation and assure equipment integrity. Passing the positive test means that the cement and casing integrity is intact in preventing fluid leak to the formation. The positive test is performed typically by applying excess surface pressure onto the wellbore, such as the maximum expected pressure during operating life of the wellbore.

The inflow negative test is performed by displacing a lighter fluid to the wellbore to stimulate underbalance scenario with the isolated formation thus confirming that there will be no fluid penetration from the formation to the wellbore. Underbalance refers to the scenario where the wellbore pressure is less than internal fluid pressure of the formation. To perform the negative test in a controlled manner, a testing packer is utilized as a mechanism to control the wellbore quickly in case the inflow negative test fails. During the mud displacement, the drill string is displaced to water through an opening port of the testing packer assembly or through an open-end of the drill string. The circulation pressure increases as the lighter fluid displaces the heavier drilling fluid. Upon completing the mud displacement and pressure is bled off to allow the wellbore to become underbalanced. Afterward, the wellbore is monitored for a pre-determined time period until it is concluded that the wellbore is secured, and the well integrity is confirmed.

The monitoring stage is performed from the drill pipe side by taking the flow volume readings on pre-determined time intervals (e.g., 5 or 10 mins). The volume is measured manually in liters using a vis-cup by counting the time to fill up the vis-cup in seconds. Afterward, the flow rate is determined (liters/seconds) and plotted in a Horner plot. The Horner plot is a widely used method to analyze pressure build up. In the Horner plot, fluid flow rate is plotted against a logarithmic horizontal time axis. Typically, the rig team utilizes either pre-programed excel sheet or software to analyze the flow rate trend to confirm if the wellbore is static or not. Static means that the flow stops since there is no communication and the packer and cement integrity is confirmed. The manual process of monitoring the wellbore for the inflow negative test is labor intensive and subject to human errors. In addition, the drill string is open to atmosphere in order to measure the fluid volume and fill time, thus imposing a risk on the operators since the fluid may contain hazardous gases.

SUMMARY

In general, in one aspect, the invention relates to a method to perform an inflow negative test of a wellbore in a subterranean formation. The method includes disposing a flow measuring sub in a drill string of the wellbore, wherein the flow measuring sub mechanically connects a drill pipe joint and a drill pipe of the drill string, sustaining, using a mud pump, a fluid flow downstream along an annulus and upstream along the drill pipe, wherein the annulus is formed between the drill pipe and a casing string of the wellbore, wherein the fluid flow reverses direction through an open port in a wall of the drill pipe or an open end of the drill pipe, wherein the fluid flow returns to the mud tank from the drill pipe through the flow measuring sub and the drill pipe joint, generating, using a measuring device of the flow measuring sub, flow measurement data of fluid movement through the flow measuring sub for sending to a computer device of the flow measuring sub, and determining, using the computer device and based at least on the flow measurement data, a success/failure result of the inflow negative test.

In general, in one aspect, the invention relates to a flow measuring sub for performing an inflow negative test of a wellbore in a subterranean formation. The flow measuring sub includes a hollow threaded pipe having connection flanges on both ends, wherein the threaded pipe is disposed in a drill string of the wellbore using the connection flanges to mechanically connect to a drill pipe joint and a drill pipe of the drill string, a measuring device disposed in the hollow threaded pipe to measure flow measurement data of fluid movement through the flow measuring sub, and a computer device configured to determine, based at least on the flow measurement data, a success/failure result of the inflow negative test, wherein a fluid flow is sustained, using a mud pump, downstream along an annulus and upstream along the drill pipe, wherein the annulus is formed between the drill pipe and a casing string of the wellbore, wherein the fluid flow reverses direction through an open port in a wall of the drill pipe, wherein the fluid flow returns to the mud tank from the drill pipe through the hollow threaded pipe of the flow measuring sub and the drill pipe joint.

In general, in one aspect, the invention relates to a drill string of a wellbore in a subterranean formation. The drill string includes a drill pipe joint, a drill pipe, and a flow measuring sub for performing an inflow negative test. The flow measuring sub includes a hollow threaded pipe having connection flanges on both ends, wherein the threaded pipe is mechanically connected using the connection flanges to the drill pipe joint and the drill pipe, a measuring device disposed in the hollow threaded pipe to measure flow measurement data of fluid movement through the flow measuring sub, and a computer device configured to determine, based at least on the flow measurement data, a success/failure result of the inflow negative test, wherein a fluid flow is sustained, using a mud pump, downstream along an annulus and upstream along the drill pipe, wherein the annulus is formed between the drill pipe and a casing string of the wellbore, wherein the fluid flow reverses direction through an open port in a wall of the drill pipe, wherein the fluid flow returns to the mud tank from the drill pipe through the hollow threaded pipe of the flow measuring sub and the drill pipe joint.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein include an enhanced mechanism to perform the inflow negative test at a wellsite. The mechanism includes a flow measuring sub at the surface as part of the inflow negative test assembly in the drill pipe. A sub is a special threaded pipe of a short length to connect drill pipes to drill collars, with a drill pipe connection on one end and a drill collar connection on the other. The flow measuring sub is equipped with measurement devices and connected to a computer device via wireless or wired connections. The measurement data is plotted or otherwise analyzed using the computer device in real time at the wellsite. This computer device also has the ability to transmit the measurement data to other computer systems via wireless or wired connections (e.g., USB, etc.) for further analysis.

Figure 1:
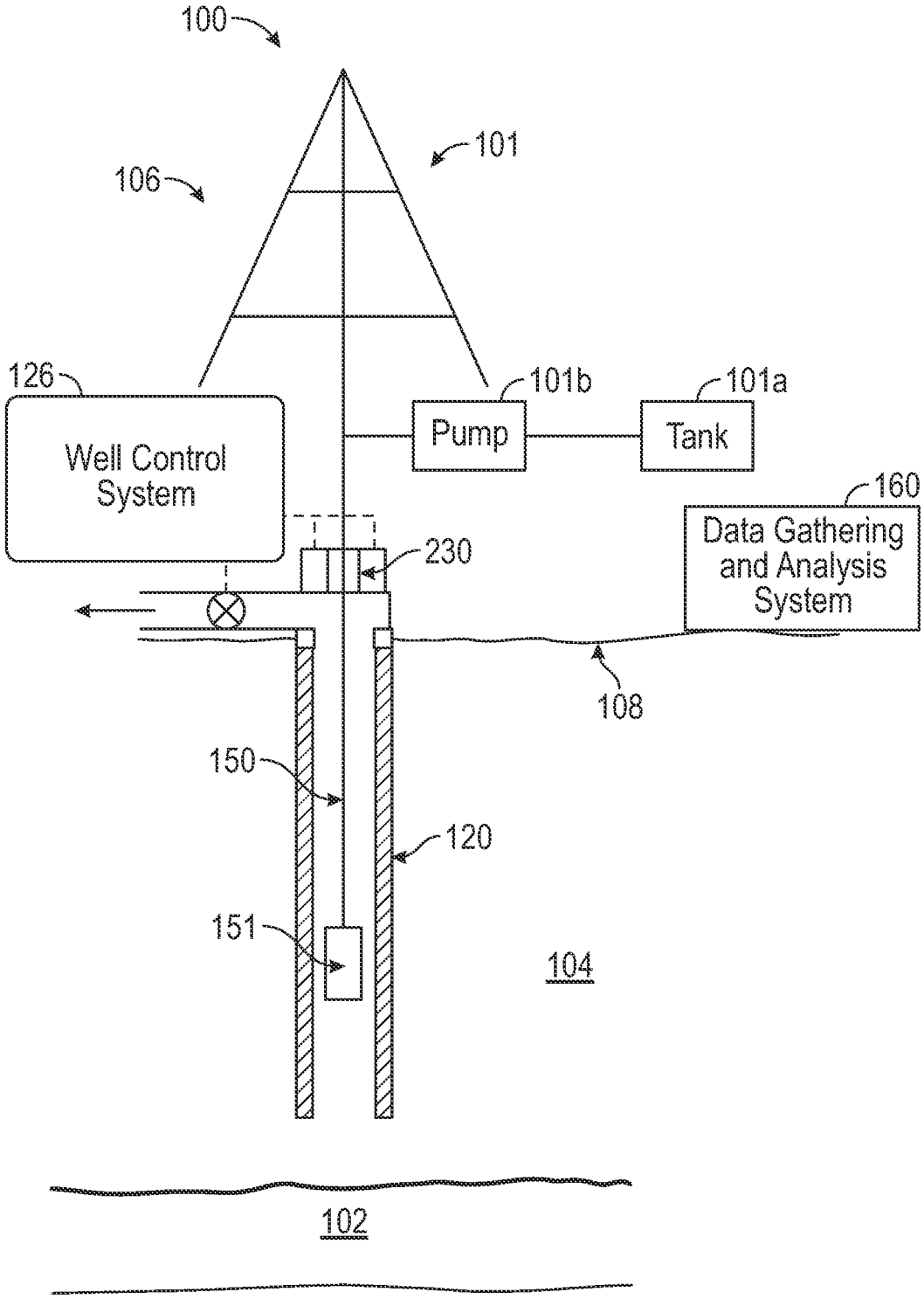
FIG. 1 shows a well system in accordance with one or more embodiments.

FIG. 1 shows a schematic diagram of a well environment in accordance with one or more embodiments. In one or more embodiments, one or more of the modules and/or elements shown in FIG. 1 may be omitted, repeated, and/or substituted. Accordingly, embodiments disclosed herein should not be considered limited to the specific arrangements of modules and/or elements shown in FIG. 1.

As shown in FIG. 1, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102). In some embodiments disclosed herein, the well system (106) includes a rig (101), a wellbore (120), a data gathering and analysis system (160), and a well control system ("control system") (126). The well control system (126) may control various operations of the well system (106), such as well production operations, well drilling operation, well completion operations, well maintenance operations, and reservoir monitoring, assessment and development operations. In some embodiments, the well control system (126) includes a computer system.

The rig (101) is the machine used to drill a borehole to form the wellbore (120). Major components of the rig (101) include the drilling fluid tanks (e.g., tank (101*a*)), the drilling fluid pumps (e.g., pump (101*b*)), the derrick or mast, the draw works, the rotary table or top drive, the drill string (e.g., drill string (150)), the power generation equipment, and auxiliary equipment. Drilling fluid, also referred to as "drilling mud" or simply "mud," is used to facilitate drilling boreholes into the earth, such as drilling oil and natural gas wells.

In some embodiments, a bottom hole assembly (BHA) (151) is attached to the drill string (150) to suspend into the wellbore (120) for performing the well drilling operation. Downhole sensors are provided in the wellbore (120) to measure downhole conditions. The sensor measurements may include temperature data, pressure data, in-situ cuttings evaluation data, etc. The bottom hole assembly (BHA) is the lowest part of the drill string (150) and includes the drill bit, drill collar, stabilizer, mud motor, etc. In one or more embodiments, the drill string (150) is provided with a flow measuring sub (230) to perform the inflow negative test.

The wellbore (120) includes a bored hole (i.e., borehole) that extends from the surface (108) towards a target zone of the formation (104), such as the reservoir (102). The wellbore (120) may be drilled for exploration, development and production purposes. The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of logging tools lowered into the formation (104) or the reservoir (102) during logging operations. The wellbore (120) may be logged by lowering a combination of physical sensors downhole to acquire data that measures various rock and fluid properties, such as irradiation, density, electrical and acoustic properties. The acquired data may be organized in a log format and referred to as well logs or well log data.

In some embodiments, the data gathering and analysis system (160) includes hardware and/or software with functionality for facilitating operations of the well system (106), such as well production operations, well drilling operation, well completion operations, well maintenance operations, and reservoir monitoring, assessment and development operations. For example, the data gathering and analysis system (160) may communicate with the flow measuring sub (230) and other downhole sensors to retrieve and analyze measurement data to facilitate the operations of the well system (106), such as the drilling operation. For example, the data gathering and analysis system (160) may generate control signals, based on the analysis results of the measurements data, for the well control system (126) to control the drilling operation in real time. While the data gathering and analysis system (160) is shown at a well site, embodiments are contemplated where at least a portion of the data gathering and analysis system (160) is located away from well sites. In some embodiments, the data gathering and analysis system (160) may include a computer system that is similar to the computing device (400) described below with regard to FIG. 4 and the accompanying description.

Figure 2A:
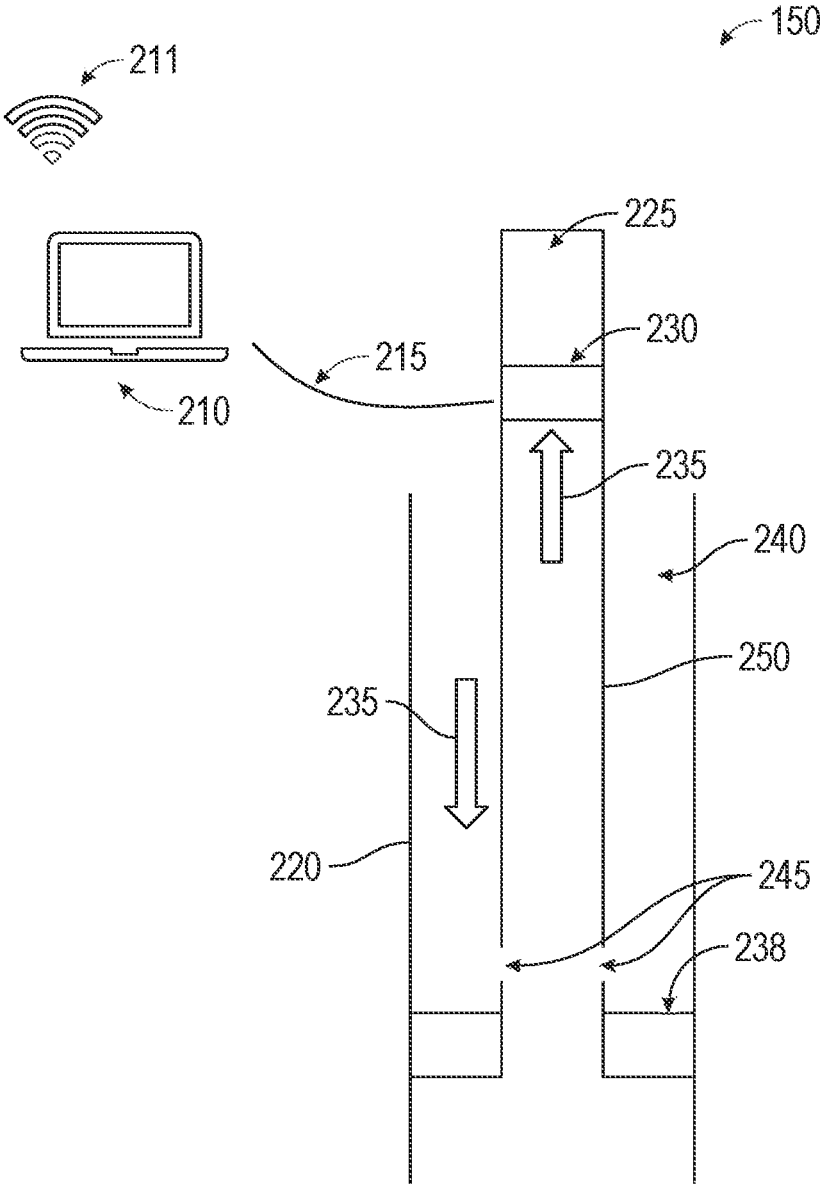
FIGS. 2A and 2B show schematic diagrams of a drilling system in accordance with one or more embodiments.
Figure 2B:
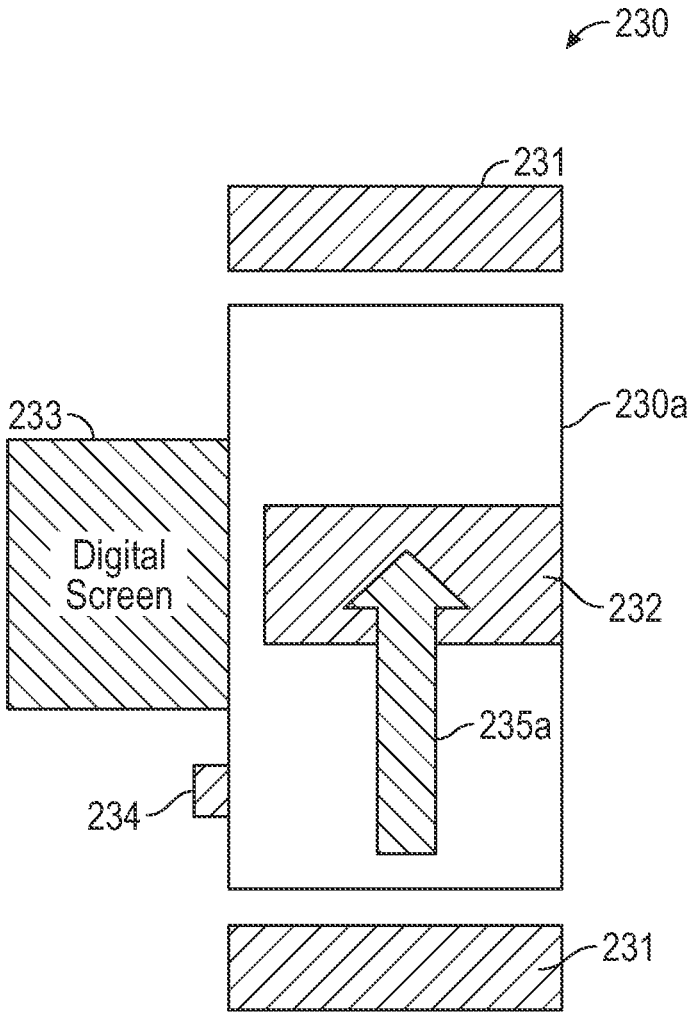

FIGS. 2A and 2B show schematic diagrams of a drilling system in accordance with one or more embodiments. In particular, FIGS. 2A and 2B illustrate details of the drill string (150) depicted in FIG. 1 above. In one or more embodiments, one or more of the modules and/or elements shown in FIGS. 2A and 2B may be omitted, repeated, and/or substituted. Accordingly, embodiments of the invention should not be considered limited to the specific arrangements of modules and/or elements shown in FIGS. 2A and 2B.

As shown in FIG. 2A, the drill string (150) includes a drill pipe joint (225), the flow measuring sub (230), and the drill pipe (250). The drill pipe joint (225) is a mechanical connection to connect the drill string (150) to other surface mechanisms of the rig (101). The flow measuring sub (230) mechanically connects the drill pipe (250) to the drill pipe joint (225) and is communicatively coupled to a computer device (210). The flow measuring sub may be permanently connected on the drill string or may be installed during the inflow negative test and removed after test completion. In contrast to the manual method of inflow negative test where the drill string is open to atmosphere in order for an operator to measure the fluid volume and fill time, connecting the flow measuring sub (230) for the inflow negative test enhances operator safety. For example, the risk of operator exposure to potential hazardous gases in the fluid is eliminated as the drill string is not required to be open during the test procedure. The flow measuring sub (230) is composed of a hollow threaded pipe and flow measuring devices for measuring the flow rate of the fluid flow (235) through the hollow threaded pipe. The computer device (210) is configured to receive measurement data from the flow measuring sub (230) for analysis and/or plotting, e.g., a Horner plot. In one or more embodiments, the analysis results and/or the Horner plot are presented to a user (e.g., test operator) who performs the inflow negative test and or associated drilling operations. The computer device (210) may be part of the data gathering and analysis system (160) depicted in FIG. 1 above, or may share the measurement data and/or analysis results with the data gathering and analysis system (160) via a wireless connection (211). During the inflow negative test, a testing packer (238) is installed between the drill string (150) and a casing string (220) of the wellbore. The drill pipe (250) and the casing string (220) form an annulus (240). The drill pipe (250) is equipped with an open port (245) to allow a displacement fluid flow (235) to flow from the surface downward in the annulus (240) and enters the drill pipe (250) via the open port (245) to return upward to the surface through the flow measuring sub (230). A mud pump (e.g., pump (101*b*) depicted in FIG. 1) receives the mud from the drill string (150) and pumps the mud to the annulus (240) to sustain the displacement fluid flow (235). The flow measuring sub (230) measures the displacement fluid flow (235) to facilitate the inflow negative test.

FIG. 2B shows details of the flow measuring sub (230) depicted in FIGS. 1 and 2A above. As shown in FIG. 2B, the flow measuring sub (230) includes a pipe (230*a*) with connection flanges (231) at both ends that are adapted to connect to the drill pipe joint (225) and the drill pipe (250) via threaded connections. The flow measuring sub (230) further includes a measuring device (232) adapted to measure the fluid flow (235). As indicated by the fluid movement (235*a*), the fluid flow (235) may be through a hollow tunnel of the measuring device (232) or passing by the measuring device (232). The measuring device (232) may be a positive displacement meter, a mass flow meter, or other types of mass velocity measuring device. The flow measuring sub (230) may also include a digital screen (233) and a commutation sub (234) to display measurement data of the measuring device (232) and/or the result of the inflow negative test from the computer device (210). The commutation sub (234) includes algorithms that gather and compute/convert the measurement data to be used in plotting the Hornor plot. The digital screen (233) and the commutation sub (234) may be part of the computer device (210) or communicates with the computer device (210) via a wired or wireless data communication connection. TABLE 1 below lists example types of data/output displayed using the digital screen (233).

TABLE 1

| | |
|---|---|
| Time | Measures the time continuously while performing the test |
| Volume displaced | Measures the volume displaced every second |
| Flow rate | Converts the time and flow measurement into flow rate (e.g., Liter/sec) |
| Graph figure | Plot the flow rate (Liter/sec) versus time (sec) to monitor the trend |

Figure 3A:
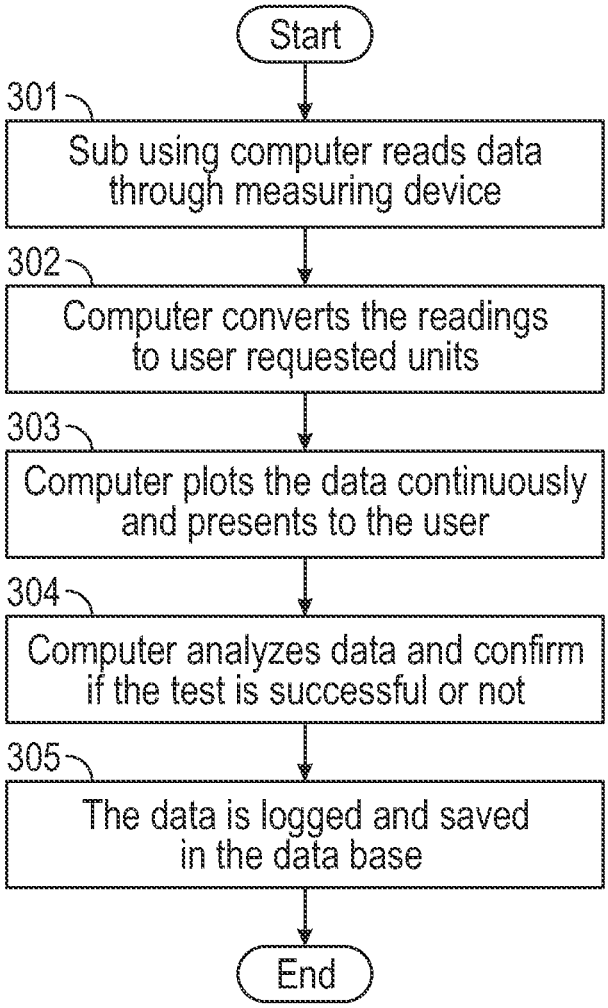
FIGS. 3A, 3B, and 3C show an example flowchart and example Horner plots in accordance with one or more embodiments.

FIG. 3A shows a flowchart in accordance with one or more embodiments disclosed herein. One or more of the steps in FIG. 3A may be performed by the components of the well environment (100), in particular the flow measuring sub (230) and the data gathering and analysis system (160), discussed above in reference to FIGS. 1 and 2A-2B. In one or more embodiments, one or more of the steps shown in FIG. 3A may be omitted, repeated, and/or performed in a different order than the order shown in FIG. 3A. Accordingly, the scope of the disclosure should not be considered limited to the specific arrangement of steps shown in FIG. 3A.

Referring to FIG. 3A, initially in Step 301, a flow measuring sub is installed in the drill string to perform the inflow negative test using the measuring device and computer device of the flow measuring sub. During the inflow negative test, the measuring device generates and sends readings recorded by the measuring device (i.e., flow measurement data) to the computer device.

In Step 302, the computer device converts the flow measurement data to user requested units. For example, the elapse time during the test may be converted into seconds and the flow rate may be converted to liters per second. The converted flow measurement data is logged in the computer device to be plotted using a software installed on the computer device.

In Step 303, the computer device plots the flow measurement data continuously. For example, the flow rate may be plotted versus time. The time it takes to accumulate 1 liter of flow volume (i.e., accumulated volume of fluid from the fluid flow) may be recorded as part of the data input to generate the plot. In another example, the flow measurement data may be plotted in real time in a Horner plot. The computer device generated plots are presented to a user via a digital display screen of the flow measuring sub.

In Step 304, the flow measurement data is analyzed by the computer device to confirm whether the inflow negative test is successful or failed. The flow measurement data and/or the analysis result may also be sent to any entity as required by the user. The inflow negative test is determined as being successful if the projected trend of flow volume decreases with time indicating that there will eventually be no fluid flow (intercept with Y-axis). On the other hand, if the projected trend of flow volume is increasing with time, the inflow negative test is determined to be a failure. Example plots of a successful test and a failed test are shown in FIG. 3B below.

In Step 305, the flow measurement data and/or the analysis result are logged and saved in a database. For example, the database may be stored in a data gathering and analysis system in communication with the computer device of the flow measuring sub. The flow measurement data and/or the analysis result may be used to select hanger vendors and cementing service companies for future drilling and completion operations. In one or more embodiments, the sub is removed from the drill string subsequent to the inflow negative test operation.

Figure 3B:
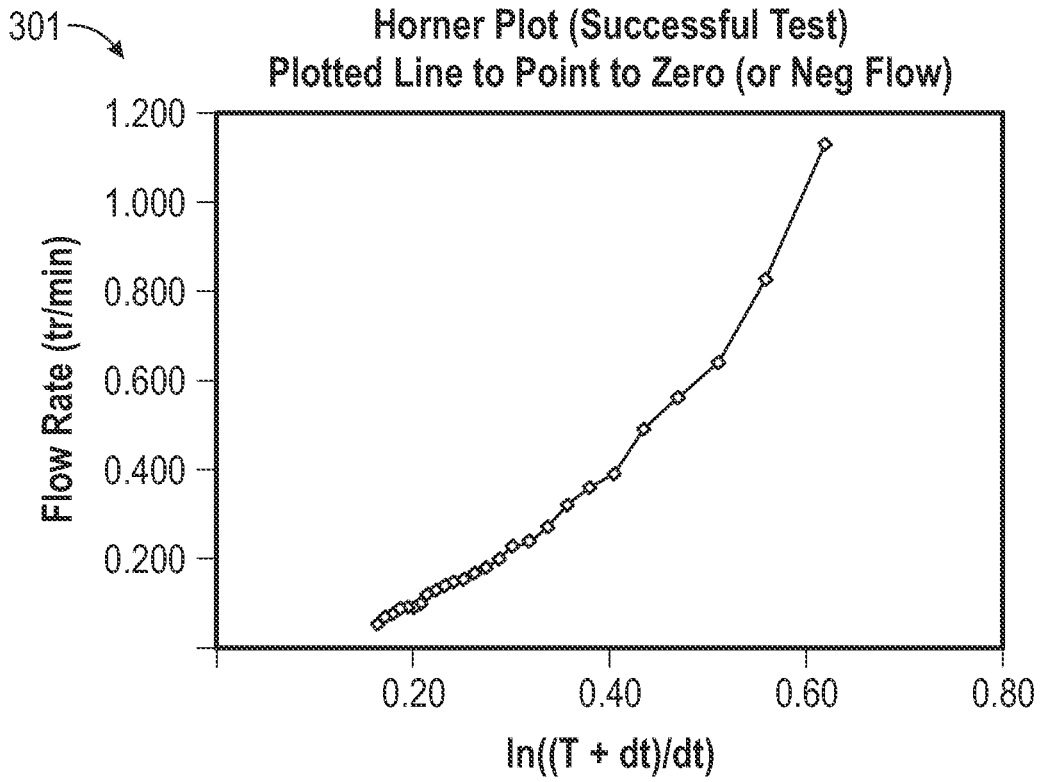
Figure 3C:
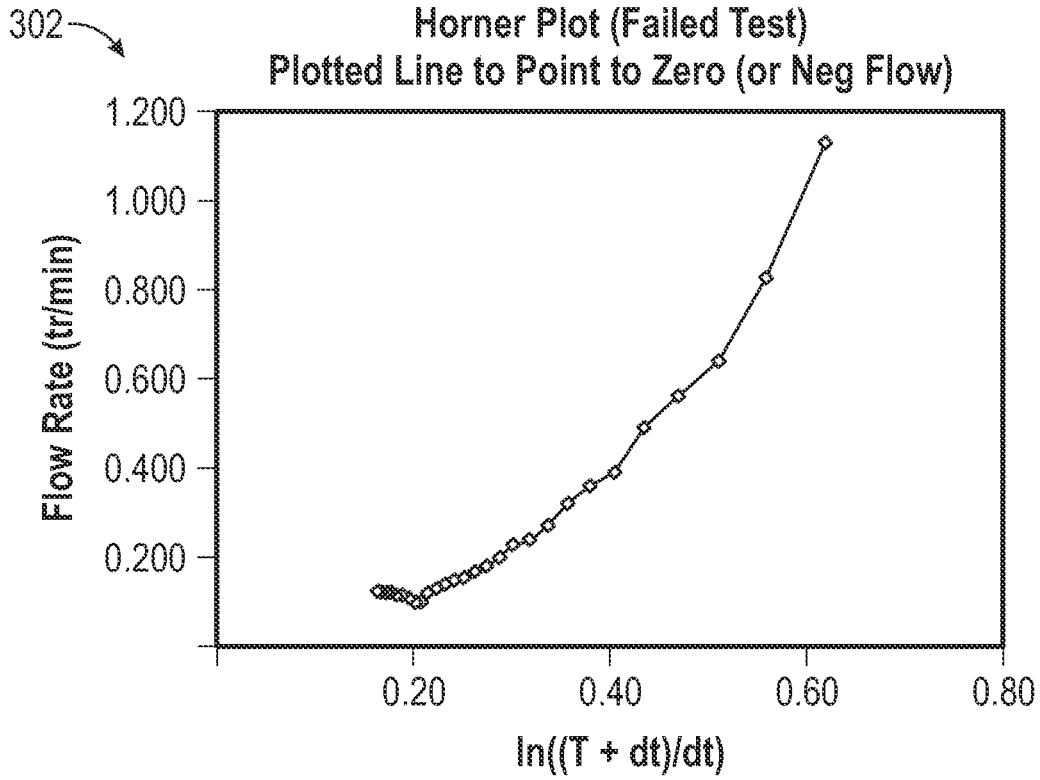

FIGS. 3B and 3C show example Horner plots in accordance with one or more embodiments disclosed herein. Specifically, FIG. 3B shows a Horner plot (301) of a successful inflow negative test and FIG. 3C shows a Horner plot (302) of a failed inflow negative test. In the Horner plots, fluid flow rate is plotted against a logarithmic time scale where T represents a total flow time and dt represents an incremental flow time. As shown in the Horner plot (301) of the successful inflow negative test, the fluid flow rate approaches 0 in the region where the logarithmic time values are below 0.20 along the horizontal axis. In contrast, in the Horner plot (302) of the failed inflow negative test, the fluid flow rate does not approach 0 in the region where the logarithmic time values are below 0.20 along the horizontal axis. For example, Horner plots in the region with logarithmic time values below 0.20 may be analyzed by the computer device to determine whether the inflow negative test is successful or failed.

Figure 4:
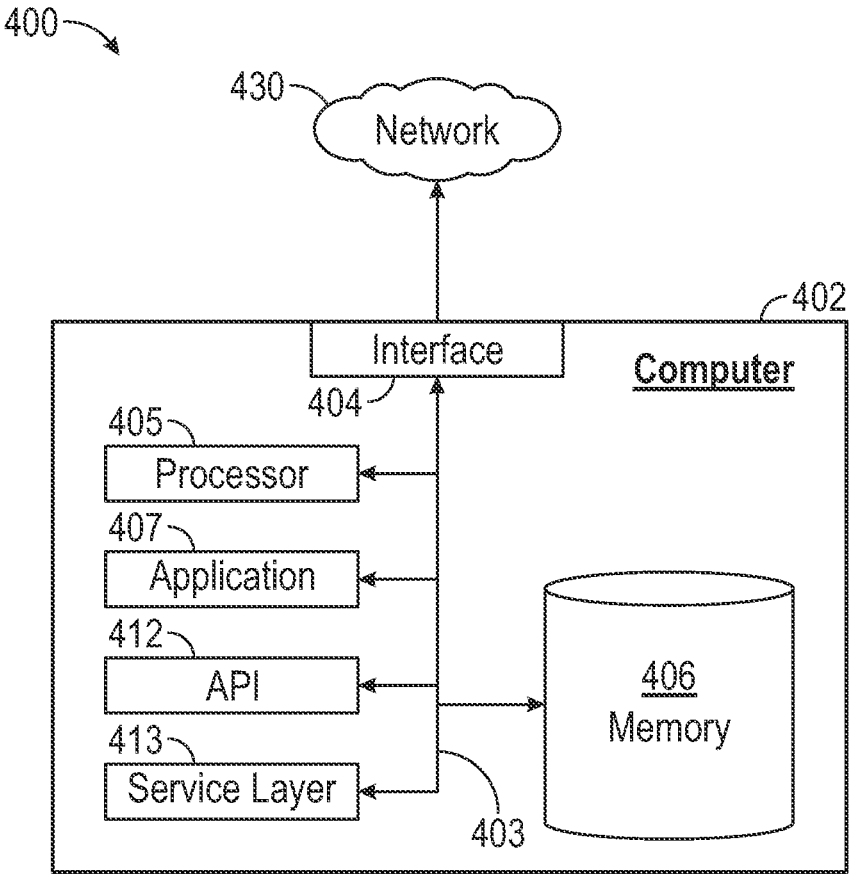
FIG. 4 shows a computing device in accordance with one or more embodiments.

Embodiments may be implemented on a computing device. For example, the in-situ sensing system (203) and data gathering and analysis system (160) may be implemented on a computer device. FIG. 4 depicts a block diagram of a computing device (400) including a computer (402) used to provide computational functionalities associated with described machine learning networks, algorithms, methods, functions, processes, flows, and procedures as described in this disclosure, according to one or more embodiments. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols, such as the Wellsite Information Transfer Specification (WITS) protocol, associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing a computer (402), wherein each computer (402) communicates over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

While the invention has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed:

1. A method to perform an inflow negative test of a wellbore in a subterranean formation, comprising:

disposing a flow measuring sub in a drill string of the wellbore, wherein the flow measuring sub mechanically connects a drill pipe joint and a drill pipe of the drill string;

sustaining, using a mud pump, a fluid flow downstream along an annulus and upstream along the drill pipe, wherein the annulus is formed between the drill pipe and a casing string of the wellbore, wherein the fluid flow reverses direction through an open port in a wall of the drill pipe or an open end of the drill pipe, wherein the fluid flow returns to a mud tank from the drill pipe through the flow measuring sub and the drill pipe joint;

generating, using a measuring device of the flow measuring sub, flow measurement data of fluid movement through the flow measuring sub for sending to a computer device of the flow measuring sub; and determining, using the computer device and based at least on the flow measurement data, a success/failure result of the inflow negative test.

2. The method of claim 1, further comprising:

sending, from the measuring device, the flow measurement data to the computer device via a wireless data communication connection.

3. The method of claim 1, further comprising:

computing, using the computer device and based at least on the flow measurement data, a fill time for a flow volume of the fluid flow to reach a pre-determined amount, wherein determining the success/failure result of the inflow negative test is based at least on the fill time.

4. The method of claim 3, further comprising:

generating, using the computer device and based at least on the flow measurement data, a Horner plot of the fluid flow, wherein determining the success/failure result of the inflow negative test is based at least on the Horner plot.

5. The method of claim 4, further comprising:

determining, using the computer device and based at least on the flow measurement data, a projected trend of the flow volume, wherein determining the success/failure result of the inflow negative test is based at least on the projected trend of the flow volume.

6. The method of claim 5, further comprising:

presenting, to a user and using a digital display screen attached to the flow measuring sub, one or more of the flow measurement data, the fill time, the Horner plot, and the projected trend of the flow volume.

7. The method of claim 5, further comprising:

selecting a type of fluid for the fluid flow such that the wellbore is in an underbalanced condition for the inflow negative test.

8. A flow measuring sub for performing an inflow negative test of a wellbore in a subterranean formation, comprising:

a hollow threaded pipe having connection flanges on both ends, wherein the threaded pipe is disposed in a drill string of the wellbore using the connection flanges to mechanically connect to a drill pipe joint and a drill pipe of the drill string;

a measuring device disposed in the hollow threaded pipe to measure flow measurement data of fluid movement through the flow measuring sub; and a computer device configured to determine, based at least on the flow measurement data, a success/failure result of the inflow negative test, wherein a fluid flow is sustained, using a mud pump, downstream along an annulus and upstream along the drill pipe, wherein the annulus is formed between the drill pipe and a casing string of the wellbore, wherein the fluid flow reverses direction through an open port in a wall of the drill pipe or an open end of the drill pipe, wherein the fluid flow returns to a mud tank from the drill pipe through the hollow threaded pipe of the flow measuring sub and the drill pipe joint.

9. The flow measuring sub of claim 8, wherein the measuring device sends the flow measurement data to the computer device via a wireless data communication connection.

10. The flow measuring sub of claim 8, wherein the computer device computes, based at least on the flow measurement data, a fill time for a flow volume of the fluid flow to reach a pre-determined amount, and wherein determining the success/failure result of the inflow negative test is based at least on the fill time.

11. The flow measuring sub of claim 10, wherein the computer device generates, based at least on the flow measurement data, a Horner plot of the fluid flow, wherein determining the success/failure result of the inflow negative test is based at least on the Horner plot.

12. The flow measuring sub of claim 11, wherein the computer device determines, based at least on the flow measurement data, a projected trend of the flow volume, wherein determining the success/failure result of the inflow negative test is based at least on the projected trend of the flow volume.

13. The flow measuring sub of claim 12, further comprising:

a digital display screen attached to the flow measuring sub for presenting, to a user, one or more of the flow measurement data, the fill time, the Horner plot, and the projected trend of the flow volume.

14. The flow measuring sub of claim 13, wherein a type of fluid for the fluid flow is selected such that the wellbore is in an underbalanced condition for the inflow negative test.

15. A drill string of a wellbore in a subterranean formation, comprising:

a drill pipe joint;

a drill pipe; and a flow measuring sub for performing an inflow negative test, comprising:

a hollow threaded pipe having connection flanges on both ends, wherein the threaded pipe is mechanically connected using the connection flanges to the drill pipe joint and the drill pipe;

a measuring device disposed in the hollow threaded pipe to measure flow measurement data of fluid movement through the flow measuring sub; and a computer device configured to determine, based at least on the flow measurement data, a success/failure result of the inflow negative test, wherein a fluid flow is sustained, using a mud pump, downstream along an annulus and upstream along the drill pipe, wherein the annulus is formed between the drill pipe and a casing string of the wellbore, wherein the fluid flow reverses direction through an open port in a wall of the drill pipe or an open end of the drill pipe, wherein the fluid flow returns to a mud tank from the drill pipe through the hollow threaded pipe of the flow measuring sub and the drill pipe joint.

16. The drill string of claim 15, wherein the measuring device sends the flow measurement data to the computer device via a wireless data communication connection.

17. The drill string of claim 15, wherein the computer device computes, based at least on the flow measurement data, a fill time for a flow volume of the fluid flow to reach a pre-determined amount, and wherein determining the success/failure result of the inflow negative test is based at least on the fill time.

18. The drill string of claim 17, wherein the computer device generates, based at least on the flow measurement data, a Horner plot of the fluid flow, wherein determining the success/failure result of the inflow negative test is based at least on the Horner plot.

19. The drill string of claim 18, wherein the computer device determines, based at least on the flow measurement data, a projected trend of the flow volume, wherein determining the success/failure result of the inflow negative test is based at least on the projected trend of the flow volume.

20. The drill string of claim 19, the flow measuring sub further comprising:

a digital display screen for presenting, to a user, one or more of the flow measurement data, the fill time, the Horner plot, and the projected trend of the flow volume.

* * * * *